US007366451B2

(12) United States Patent
Yokoyama

(10) Patent No.: US 7,366,451 B2
(45) Date of Patent: Apr. 29, 2008

(54) DEVELOPER CONVEYANCE SCREW

(75) Inventor: Katsunori Yokoyama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 11/275,602

(22) Filed: Jan. 18, 2006

(65) Prior Publication Data

US 2006/0159492 A1 Jul. 20, 2006

(30) Foreign Application Priority Data

Jan. 18, 2005 (JP) ..... 2005-010361
Jan. 12, 2006 (JP) ..... 2006-004719

(51) Int. Cl.
*G03G 15/08* (2006.01)

(52) U.S. Cl. ..... 399/256

(58) Field of Classification Search ..... 399/254, 399/256; 366/154.1, 156.1, 156.2, 266, 318
See application file for complete search history.

(56) References Cited

U.S. PATENT DOCUMENTS 4,173,405 A * 11/1979 Swapceinski et al. ..... 399/256
4,906,104 A * 3/1990 Nishise et al. ..... 399/254 X
5,722,002 A * 2/1998 Kikuta et al. ..... 399/256 X
5,835,828 A * 11/1998 Jyoroku ..... 399/256
5,923,931 A * 7/1999 Kishimoto ..... 399/256

FOREIGN PATENT DOCUMENTS

JP 8-286587 1/1996

* cited by examiner

*Primary Examiner*—Sandra L. Brase
(74) *Attorney, Agent, or Firm*—Fitzpatrick, Cella, Harper & Scinto

(57) ABSTRACT

A developer feeding screw, which includes a shaft and a helical shape portion around said shaft, for feeding a developer in a direction of an axis of said shaft by rotation about the axis, said feeding screw, the improvement residing in that:

a sectional configuration of said helical shape portion in a plane including the axis satisfies:

$$Z(r)=kln(ro/r)$$

where z(r) is a height of said sectional configuration at radius r with z(ro)=0 (ro is an outer radius of the helical configuration):

r is a radius ($0<r\leqq ro$)

k is a constant.

2 Claims, 8 Drawing Sheets

DEVELOPER CONVEYANCE SCREW

FIELD OF THE INVENTION AND RELATED ART

The present invention relates to a developer conveyance screw used for an electrophotographic image forming apparatus, and a mold for forming a developer conveyance screw for an electrophotographic image forming apparatus.

An electrophotographic image forming apparatus uses an electrophotographic image forming process, which comprises a developing process, a charging process, a transferring process, etc. Here, a developing process means a process for developing, with the use of the combination of toner and a development roller, an electrostatic latent image formed on an electrophotographic photosensitive member.

In a developing process, an electric field is formed between a development roller and an electrophotographic photosensitive member. As a result, charged toner particles move from the development roller to the electrophotographic photosensitive member. Therefore, a developing process is greatly affected by the amount of the electric charge of the toner.

As one of the systems for carrying out a developing process, there has been a two-component development system, which uses toner and carrier. In a two-component development system, toner is mixed with carrier to make toner particles come into contact with carrier particles, so that toner particles are charged by the friction between them and carrier particles. Thus, in a two-component system, the mixing ratio (mass ratio) between toner and carrier must be kept stable, for the following reason.

If the mass ratio of toner relative to carrier (T/C ratio) is excessive, some toner particles fail to come into contact with carrier particles, failing to become charged, or becoming charged to the polarity opposite to the inherent polarity to which toner is charged. This results in the formation of an image suffering from fogs, and/or scattering of toner. On the other hand, if the T/C ratio is excessively low, it is possible that the so-called charge-up, that is, the phenomenon that toner is excessively charged, will occur, although whether or not the charge-up occurs depends on the properties of the mixture of toner and carrier. With toner excessively charged up, an image which is excessively low in density is sometimes formed.

Thus, in a two-component development system, a developing device is kept separated from a toner container, and in order to keep constant the T/C ratio in the developing device, an ATR system (automatic toner replenishment system) is used. In an ATR system, the T/C ratio in a developing device is sensed, and a developing device is supplied with the toner from the toner container, by the amount necessary to keep roughly constant the C/T ratio in the developing device.

An ATR system is required to keep the T/C ratio in a developing device within 8%±2%. In order to achieve this objective, the ATR system is provided with a high sensitivity T/C sensor, and a mechanism for discharging toner from a toner container at a constant ratio.

As the T/C sensor, there are a T/C sensor of the inductance type which detects the changes in the magnetic permeability of toner, and an optical sensor which detects the reflective density of the surface of a body of developer.

As an example of the structural arrangement for discharging toner from a toner container at a constant ratio, there is such a mechanism that comprises a cylindrical chamber from which toner is to be discharged at a preset ratio, and a screw disposed in the cylindrical chamber. In the case of this mechanism, as the screw is rotated, the toner in the cylindrical chamber is moved in the direction parallel with the axial line of the screw, by an amount equivalent to the volume displaced by the thread of the screw as the screw is rotated. In other words, the amount by which toner is discharged into a developing device can be controlled by controlling the revolution of the screw, with the use of the toner conveyance mechanism of the screw type.

Considering a developing device as a system, the aforementioned ATR is for keeping constant the T/C ratio for the entirety of the system. Moreover, in order to keep constant the T/C ratio in the development area to stabilize the developing process, a developing device is required to have the functions of charging toner by stirring the developer, that is, a mixture of toner and carrier, conveying the developer to a development roller, and recovering the unused developer.

As for the structural arrangement for stirring the developer (mixture of toner and carrier) in a developing device, supplying the developing device with toner, and recovering unused portion of the developer in the developing device from the developing device, such a structural arrangement is employed that circulates the developer in the developing means container of the developing device, with the use of two screws, the axle of each of which is parallel with a development sleeve.

In other words, as the means for supplying the two-component developing device of an electrophotographic image forming apparatus with toner, and circulating the developer (mixture of toner and carrier) in the developing device, a developer conveyance screw has been widely used (Japanese Laid-open Patent Application 08-286587).

Most of the abovementioned development conveyance screws are molded in a single piece. More specifically, some of them are formed of resin alone by molding, whereas others are made up of a metallic rotational shaft portion and resinous thread portion, and are formed by insert molding. There are also the cutting method and rolling method as the method for manufacturing a developer conveyance screw. The cutting method and rolling method, however, suffer from the following problems. That is, if the length of a development conveyance screw is substantially greater than the diameter of the screw, the screw is bent while being manufactured by cutting or rolling. In other words, the cutting and rolling method suffer from the problem related to the strength of a screw. They are also problematic in terms of productivity and cost. Therefore, these processing methods are not suitable for the mass production of a screw.

On the other hand, when forming a developer conveyance screw of resin, by molding, the screw needs to be shaped so that the mold therefor can be removed (opened) in the radius direction of the screw. In the case of a screw in accordance with the prior art, which is shaped so that the flanks of the thread portion of the screw are straight in cross section as shown in FIG. 1, the direction of the normal line of the flank of the thread portion, relative to a plane which is parallel with the axial line of the screw is affected by the radius of the screw. Thus, in order to make such a two piece mold for the screw that does not have the undercuts and can be removed in the opposing two directions, the plane at which the two piece mold is to be separated into two pieces has to given a curvature, making it rather difficult to manufacture the mold for the screw. Therefore, the mold for a screw in accordance with the prior art has been constructed so that it is separated into three pieces which are removed in three different directions (120° apart), one for one, or four pieces which are removed, including sliding, in the four different direction (90° apart), one for one.

However, the molding method which uses a three-piece mold or a four-piece mold is disadvantageous compared to the molding method which uses a two-piece mold, in that the former is greater in cycle time than the latter.

SUMMARY OF THE INVENTION

Thus, the primary object of the present invention is to provide a developer conveyance screw which is smooth in shape (uniform in cross section, at plane inclusive of axial line, of thread portion (spiral portion)), with the use of a two-piece mold.

According to an aspect of the present invention, there is provided a developer feeding screw, which includes a shaft and a helical shape portion around said shaft, for feeding a developer in a direction of an axis of said shaft by rotation about the axis, said feeding screw, the improvement residing in that:

a sectional configuration of said helical shape portion in a plane including the axis satisfies:

$$Z(r)=kln(ro/r)$$

where z(r) is a height of said sectional configuration at radius r with z(ro)=0 (ro is an outer radius of the helical configuration):

r is a radius ($0<r\leqq ro$)

k is a constant.

In a developer conveying apparatus structured in accordance with the present invention, the cross-sectional shape of the screw, at a plane which coincides with the axial line of the screw, shown in FIG. 1, is expressed by the following function:

$$Z(r)=kln(ro/r)$$

Z(r): height of cross section of thread portion, radius of which is r (z(ro)=0)

ro: major radius of thread portion $$r\text{:radius } (0\leqq r\leqq ro) \quad (1)$$

k: constant.

Thus, the projection of the vector parallel with the normal line of the flank of the thread portion at θ0 (θ=θ0) in the cylindrical coordinate system, the z axis of which coincides with the axial line of the screw ($n_x$, that is, x component of vector parallel with the normal line, that is, the projection of vector onto plane xz, for example), onto any plane parallel with the axial line of the screw can be made constant regardless of the radius r.

In other words, as long as the mold is split in the area of the mold, in which the abovementioned $n_x$ becomes positive and negative (undercut portion), the shape of the plane at which the mold is split becomes independent from the radius r. Therefore, the mold can be split into two pieces, which are flat across the surface resulting from the splitting, making it easier to manufacture a two-piece mold for a developer conveyance screw.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

First, an electrophotographic image forming apparatus structured in accordance with the present invention will be described with reference to the appended drawings.

(General Description of Entirety of Image Forming Apparatus)

Figure 1:
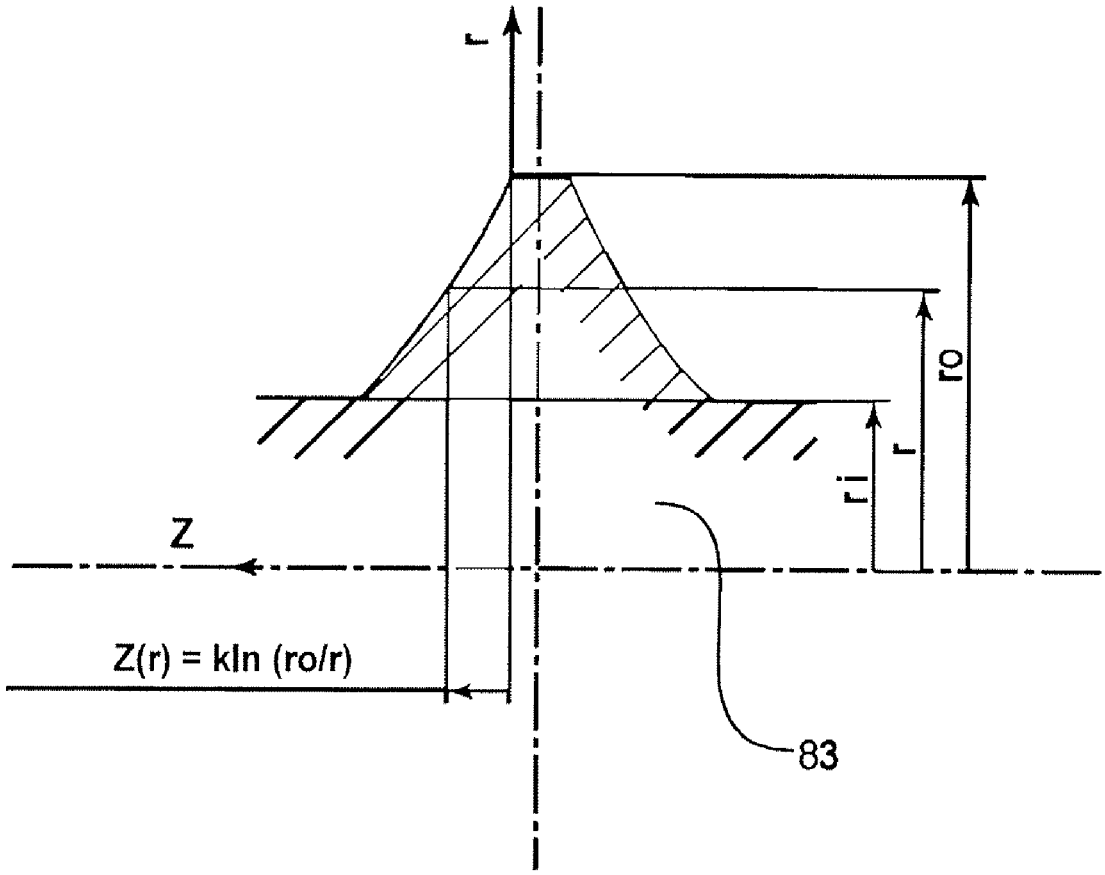
FIG. 1 is a sectional view of the developer conveyance screw in accordance with the present invention, at a plane coinciding with the axial line of the screw, showing the cross-sectional shape of the thread portion of the screw.
Figure 2:
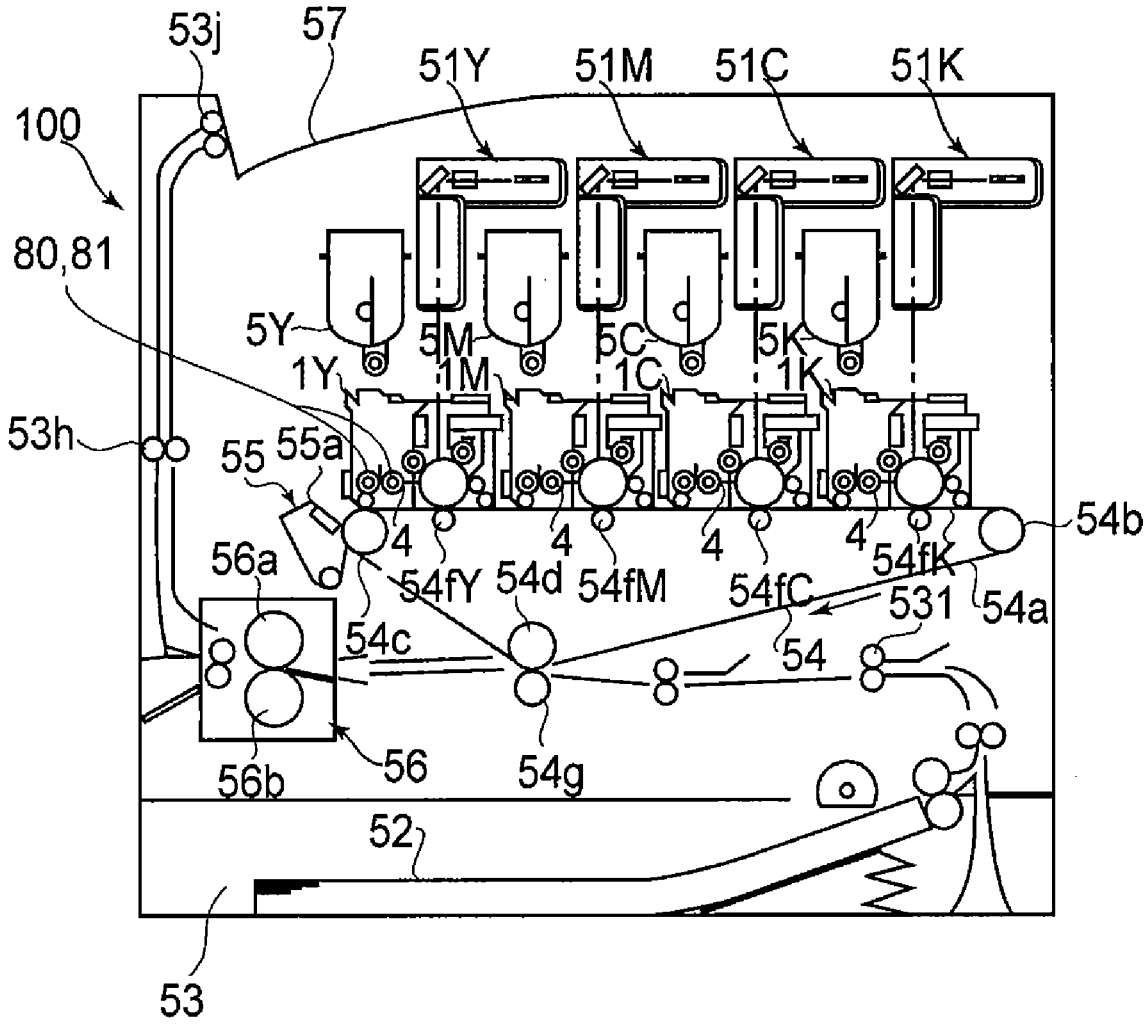
FIG. 2 is a sectional view of the main assembly of an image forming apparatus in accordance with the present invention.

FIG. 2 is a sectional view of an electrophotographic image forming apparatus in accordance with the present invention.

The image forming portion of this image forming apparatus is provided with four process cartridges 1 (1Y, 1M, 1C, and 1K, corresponding to yellow, magenta, cyan, and black colors, respectively), each of which has a photosensitive drum 2 as an image bearing member. The image forming portion is also provided with exposing means 51 (51Y, 51M, 51C, and 51K) which correspond to the abovementioned colors, respectively, and are disposed above the abovementioned cartridges 1, respectively.

Below the image forming portion, a sheet feeding portion for feeding a recording medium 52 into the main assembly of the image forming apparatus, an intermediary transfer belt 54*a*, and a secondary transfer roller 54*d* are disposed. The intermediary transfer belt 54*a* is a belt, onto which the multiple toner images, which are different in color and are formed on the four photosensitive drums 2, one for one, are transferred in layers to form a single full-color image. The secondary transfer roller 54*d* is a roller for transferring the toner images (single full-color image) on the intermediary transfer roller 54*a* onto the recording medium 52.

Further, the image forming apparatus main assembly 100 is provided with a fixing means 56 for fixing the toner images on the recording medium 52 to the fibers of the recording medium 52 by melting the toner images while applying pressure thereto, and a discharging means for discharging the recording medium 52 from the image forming apparatus.

(Description of Various Portions of Image Forming Apparatus Main Assembly)

Next, the various portions of the above described image forming apparatus will be described regarding their structures.

(Sheet Feeding Portion)

The sheet feeding portion 53 stores recording mediums 52, and supplies the image forming portion with the recording medium 53, with preset intervals in time.

(Process Cartridge)

A process cartridge 1 has a photosensitive drum 2, a charging means, and a developing means. The charging means and developing means are disposed in the adjacencies of the peripheral surface of the photosensitive drum 2. The process cartridge 1 is removably mountable in the image forming apparatus main assembly 100, allowing a user to easily replace it as the photosensitive drum 2 therein deteriorates with usage or elapse of time.

Figure 3:
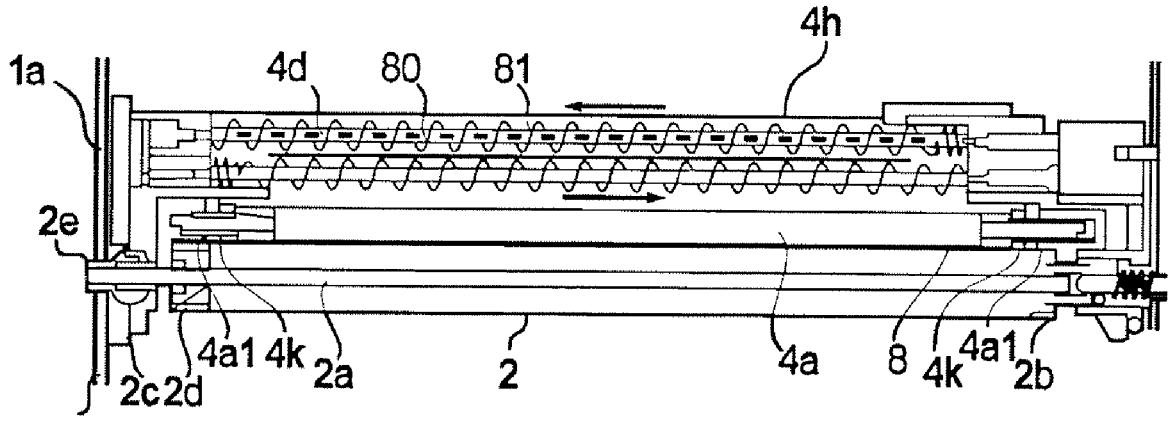
FIG. 3 is a sectional view of the developing apparatus in accordance with the present invention.

Referring to FIG. 3, the photosensitive drum 2 is provided with a drum flange 2*b*, which is attached to one of the lengthwise ends of the photosensitive drum 2, and a drum flange 2*d*, which is attached to the other lengthwise end. The flange 2*d* is not the flange through which the photosensitive drum 2 is driven. Through the shaft of the photosensitive drum 2, a drum axle 2*a* is put, and the drum axle 2*a* is locked to the drum flange 2*b*. Thus, the drum axle 2*a* and drum flange 2*b* rotate together.

The end portion of the drum axle 2*a*, which is on the flange 2*d* side, is rotatably supported with a bearing 2*e*, which is rigidly attached to the frame 1*a* of the cartridge 1, with the bearing case 2*c* placed between the bearing 2*e* and frame 1*a*.

(Charging Means)

Figure 9:
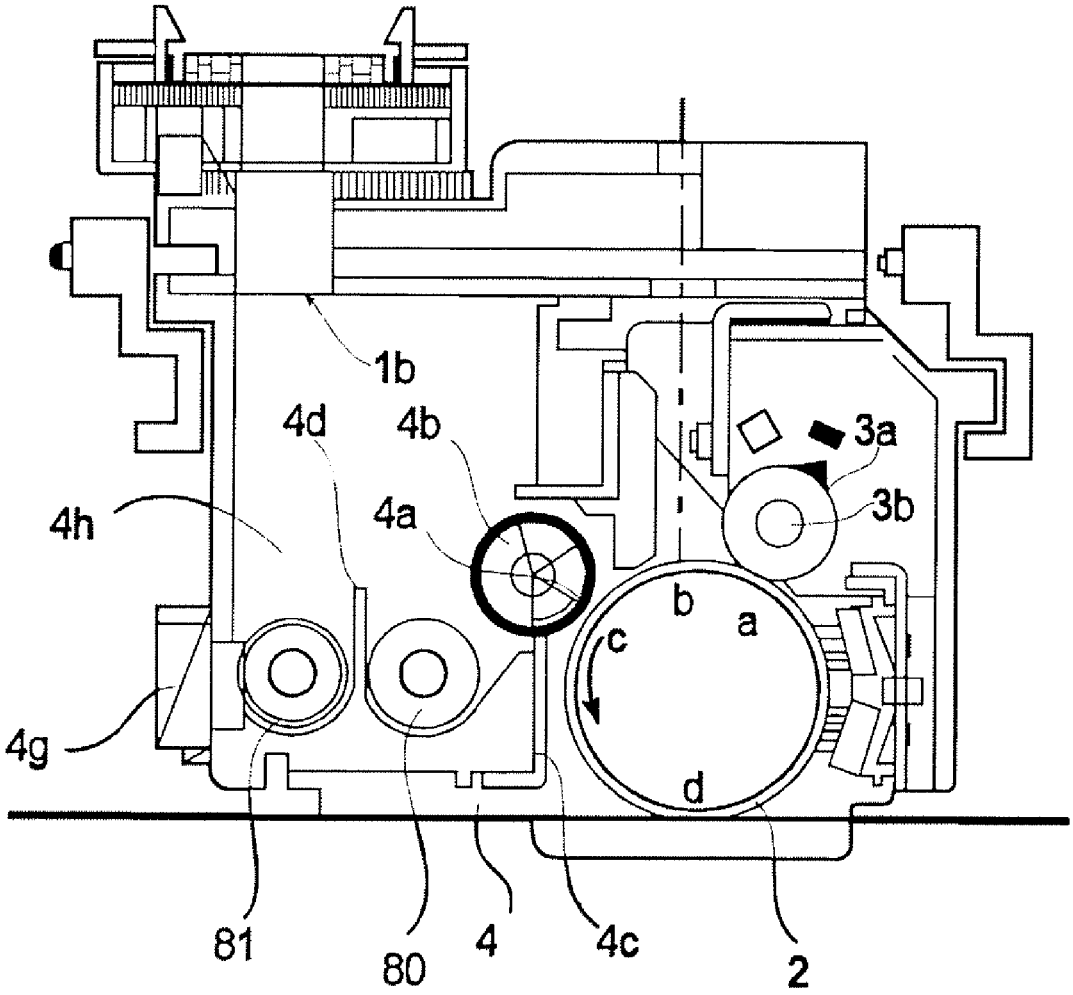
FIG. 9 is a sectional view of the process cartridge in accordance with the present invention.

The abovementioned charging means uses the contact charging method. Referring to FIG. 9, in this embodiment of the present invention, a charge roller 3*a* is used as the charging means. The charge roller 3*a* is rotatably supported by a pair of bearing members (unshown) by the lengthwise end portions of its metallic cores 3*b*. The charge roller 3*a* is kept pressed toward the axial line of the photosensitive drum 2 by a pair of coil springs of the compression type, being thereby made to press upon the peripheral surface of the photosensitive drum 2 so that a preset amount of pressure is maintained between the charge roller 3*a* and photosensitive drum 2.

(Exposing Means)

In this embodiment of the present invention, an electrostatic latent image is formed on the photosensitive drum 2 with the use of an exposing means based on laser.

More specifically, as video signals (image formation signals) are sent from the apparatus main assembly 100, a beam of laser light L is projected, while being modulated with these video signals, in a manner to scan the uniformly charged peripheral surface of the photosensitive drum 2. As a result, the peripheral surface of the photosensitive drum 2 is exposed; an electrostatic latent image, which reflects the image formation data, is formed on the peripheral surface of the photosensitive drum 2.

(Developing Apparatus)

Next, referring to FIG. 9, the developing apparatus 4 will be described. The developing apparatus 4 is of the contact type, and uses a developer made up of two components (developing apparatus of magnetic brush type, which uses two-component developer). In the hollow of the development sleeve 4*a* as a developer bearing member, a magnetic roller 4*b* is disposed. On the development sleeve 4*a*, developer made up of carrier and toner is borne. Directly below the development sleeve 4*a*, a regulation blade 4*c* is disposed with the presence of a preset amount of clearance between the development sleeve 4*a* and blade 4*c*. As the development sleeve 4*a* is rotated in the direction indicated by an arrow mark, a thin layer of developer is formed on the development sleeve 4*a*.

Referring to FIG. 3, the development sleeve 4*a* is provided with a pair of journals 4*a*1, which are attached to the lengthwise ends of the development sleeve 4*a* one for one. Each journal 4*a*1 is rotatably fitted with a spacer ring 4*k*. The development sleeve 4*a* is supported by a pressure applying means (unshown) so that the spacer rings 4*k* are kept in contact with the photosensitive drum 2. Thus, the clearance between the development sleeve 4*a* and photosensitive drum 2 is maintained at a preset value. The direction in which the development sleeve 4*a* in this embodiment is rotated is opposite to the direction in which the photosensitive drum 2 is rotated (counter development)

The developer used in this embodiment is a mixture of toner and carrier. The toner is 6 μm in average particle diameter, and the inherent polarity to which it becomes charged is negative. The carrier is 35 μm in average particle diameter. The mass ratio of the toner to the carrier in the developer is 8%.

Referring to FIGS. 9 and 3, the developer storage portion 4*h* is provided with a partitioning wall 4*d*, with the provision of a gap as a developer transfer path between each of the lengthwise ends of the partitioning wall 4*d* and the corresponding wall of the developer storage portion 4*h*. Further, the developer storage portion 4*h* is provided with a pair of developer conveyance screws 80 and 81, which are disposed on each side of the partitioning wall 4*d*, one for one.

Referring to FIG. 3, as the toner T is supplied from a replenishment toner container 5 (5Y, 5M, 5C, and 5K), it lands on the right hand end portion of the screw 81. Then, the toner T is conveyed, while being stirred, leftward of FIG. 3, along the groove of the partitioning walls 4*d*, which is on the screw 81 side. Then, it is transferred to the screw 80 through the aforementioned gap between the lengthwise left end of the partitioning wall 4*d* and the corresponding wall of the developer storage portion 4*h* (gap is provided between each lengthwise end of partitioning wall 4*d* and corresponding wall of developer storage portion). Then, it is conveyed, while being stuffed, rightward of FIG. 3, along the groove of the partitioning wall 4*d*, which is on the screw 80 side. Then, it is transferred to the screw 81 through the aforementioned gap between the lengthwise right end of the partitioning wall 4*d* and the corresponding wall of the developer storage portion 4*h*. In other words, the toner T is repeatedly circulated through the developer storage portion 4*h*.

(Developing Means)

At this time, referring to FIG. 9, the developing process in which an electrostatic latent image formed on the photosensitive drum 2 is developed into a visible image (image formed of toner) with the use of the magnetic brush formed of two-component developer, will be described.

First, the developer in the developer storage portion 4*h* is adhered to the peripheral surface of the development sleeve 4*a* by the function of the magnetic pole (development pole) of the magnetic roller 4*b*. Thus, as the development sleeve 4*a* is rotated, the developer is picked up by the surface of the development sleeve 4*a*. Then, as the development sleeve 4*a* is further rotated, the developer thereon is moved through the gap between the peripheral surface of the development sleeve 4*a* and regulation blade 4*c*, being thereby formed into a thin layer of the developer, which is uniform in thickness. Then, as the development sleeve 4*a* is further rotated, this thin layer portion of the developer on the peripheral surface of the development sleeve 4*a* is brought into the development area where the distance between the peripheral surface of the photosensitive drum 2 and development sleeve 4*a* is smallest. As a result, the thin layer of the developer is made to agglomerate in the shape of the tip of a broom by the function of the magnetic pole (development pole) of the magnetic roller 4*b*. In this development area, the toner T (toner particles on the surface of each carrier particle) transfers onto the numerous points (exposed points) of the aforementioned electrostatic latent image, which have been reduced in potential level by exposure. As a result, a visible image is formed of toner, on the photosensitive drum 2.

As the development sleeve 4*a* is further rotated, the portion of the thin layer of the toner on the development sleeve 4*a*, which has not been transferred onto the photosensitive drum 2, is moved past the development area, and is made to enter again the developer storage portion 4*h*, in which the toner remaining on the development sleeve 4*a* is peeled away from the development sleeve 4*a* by the function of the magnetic field generated by the magnetic pole (conveyance pole) of the magnetic roller 4*b*, which is on the opposite side of the magnetic roller 4*b* from the development pole, being thereby returned to the body of the developer which is being circulated through the developer storage portion 4*h*.

To the development sleeve 4*a*, development bias is applied from a high voltage power source (unshown). In this embodiment, the development bias applied between the development sleeve 4*a* and the substrate of the photosensitive drum 2 is the combination of a DC voltage, which is in the range of −200--650 V, and an AC voltage, which is 1.8 kV in peak-to-peak voltage and 2 kHz in frequency.

As the toner in the developer storage portion 4*h* is consumed through development, the developer in the developer storage portion 4*h* is reduced in toner density (percentage in terms of mass). As the developer storage portion 4*h* is reduced in toner density, the amount of the toner in the development area becomes insufficient. Therefore, the satisfactory level of development density cannot be achieved even if the development bias is increased. Further, if the developer is extremely reduced in toner density, the toner particles in the developer are excessively charged (charged up), failing to separate from the carrier particles. As a result, it becomes difficult for a latent image on the photosensitive drum 2 to be properly developed.

On the other hand, if the developer is extremely increased in toner density, some toner particles in the developer fail to be given a sufficient amount of electric charge. As a result, a foggy image is formed and/or toner is scattered.

In this embodiment, therefore, a measure is taken to maintain the toner density of the developer at 8%±2% (mass percentage). More specifically, a toner density sensor 4*g* is positioned near the ridge of screw 81 to detect the toner density of the developer in the aforementioned area through which the developer is circulated.

The density sensor 4*g* detects the changes in the magnetic permeability of the developer, based on the fact that the carrier is a paramagnetic substance. Then, the toner density of the developer is obtained from the amount of the carrier per unit volume of the developer.

The controller with which the apparatus main assembly 100 is provided detects the drop in the toner density detected by the density sensor 4*g*. As the controller detects the drop, it sends to a toner replenishment unit 5 a request for a toner replenishment operation. As a result, a preset amount of toner is supplied to the developing apparatus from the toner replenishment unit 5.

(Toner Replenishment Unit)

Next, the toner replenishment unit 5 located on top of the developing apparatus 4 will be described.

The toner replenishment unit 5 is inserted into the apparatus main assembly 100 from the front side of the apparatus main assembly 100, along the guide rails (unshown) with which the frame of the apparatus main assembly 100 is provided. As the toner unit 5 is inserted, the replenishment unit 5 is locked, by an insertion lock (unshown), in a location in which the toner outlet of the replenishment 5 directly opposes the toner inlet 1*b* of the developing apparatus 4. As a result, a passage through which toner is supplied from the replenishment unit 5 to the developing apparatus is created.

In the replenishment unit 5, toner is stored by the amount sufficient to print 10,000 copies, which are 5% in print ratio. The toner in the replenishment unit 5 is stirred by a stirring blade (unshown) with preset intervals in time. The replenishment unit 5 is provided with a toner measurement screw (unshown), which is disposed in the bottom portion of the unit 5. The toner measurement screw is driven by the apparatus main assembly 100 through a joint. As a request for toner replenishment is issued by the ATR control, the abovementioned toner measurement screw is rotated by the number of times which correspond to the preset amount of toner. As a result, the preset amount of toner is conveyed to the toner outlet, and falls into the developing apparatus 4 though the toner inlet 1*b* of the developing apparatus 4.

(Transferring Means)

Referring to FIG. 2, the intermediary transfer unit 54 as a transferring means sequentially transfers (primary transfer) in layers the toner images from the photosensitive drums 2 (one from each photosensitive drum 2) onto the intermediary transfer belt 54*a*, and then, transfers (secondary transfer) all at once the toner images from the intermediary transfer belt 54*a* onto the recording medium 52.

The intermediary transfer unit 54 is provided with the intermediary transfer belt 54*a*, which runs in the direction indicated by an arrow mark at roughly the same peripheral velocity as that of the photosensitive drum 2. The intermediary transfer belt 54*a* is stretched around, being thereby supported by, three rollers, that is, a driver roller 54*b*, a belt backing roller 54*d* for secondary transfer, and a follower roller 54*c*.

On the inward side of the loop which the intermediary transfer belt 54*a* forms, transfer rollers 54*f* (54*f*Y, 54*f*M, 54*f*C, and 54*f*K) are disposed, opposing the photosensitive drums 2 one for one. Each transfer roller 54*f* is kept pressed against the corresponding photosensitive drum 2 toward the axial line of the photosensitive drum 2, with the intermediary transfer belt 54*a* pinched between the transfer roller 54*f* and photosensitive drum 2.

To each transfer roller 54*f*, transfer voltage is applied from a high voltage power source. As the transfer voltage is applied, the toner images on the photosensitive drums 2 are sequentially transferred (primary transfer) onto the intermediary transfer belt 54*a*.

In the secondary transfer portion, a secondary transfer roller 54*g* is disposed so that it is pressed against the intermediary transfer belt backing roller 54*d* for secondary transfer, with the intermediary transfer belt 54*a* pinched between the secondary transfer roller 54*g* and belt backing roller 54*d*. As the recording medium 52 enters the secondary transfer portion, a preset transfer bias is applied to the secondary transfer roller 54*g*. As a result, the toner images on the intermediary transfer belt 54*a* are transferred (secondary transfer) onto the recording medium 52.

After the secondary transfer, the recording medium 52 is conveyed toward a fixing device 56 by the driving force generated in the direction which coincides with the direction of the line which is tangential to the secondary transfer roller 54*g* and secondary transfer belt 54*a*.

Meanwhile, the toner which remained on the development sleeve 4*a* in the secondary transfer portion is separated from the intermediary transfer belt 54*a* by the blade 55*a* of a cleaning unit 55.

(Fixing Portion)

In the fixing portion 56 in this embodiment, the toner images on the recording medium 52 are welded to the recording medium 52 by thermally melting the toner images with the use of a pair of rollers.

(Fixing Operation)

The recording medium 52 is conveyed into the fixing portion 56, with the surface of the recording medium 52, which is bearing the transferred toner images, facing upward, and then, it is conveyed through the nip formed between the fixation roller 56*a* and pressure roller 56*b*, while remaining pinched between the two rollers 56*a* and 56*b*. As it is conveyed through the nip, it is subjected to heat and pressure. As a result, the toner images are welded (fixed) to the recording medium 52. Thereafter, the recording medium 52 is discharged from the apparatus main assembly 100.

(Sheet Discharging Portion)

After being conveyed through the fixing portion 56, the recording medium 52 is conveyed further by a pair of sheet conveyance rollers 53*h* and a pair of FD sheet discharge rollers 53*j*, being thereby discharged from the top portion of the apparatus main assembly 100 into an FD tray 57, in which it is accumulated.

Detailed Description of Embodiment

Next, the developer conveyance screw 80 (81) in this embodiment of the present invention will be described in more detail.

(Developer Conveyance Screw]

Figure 4:
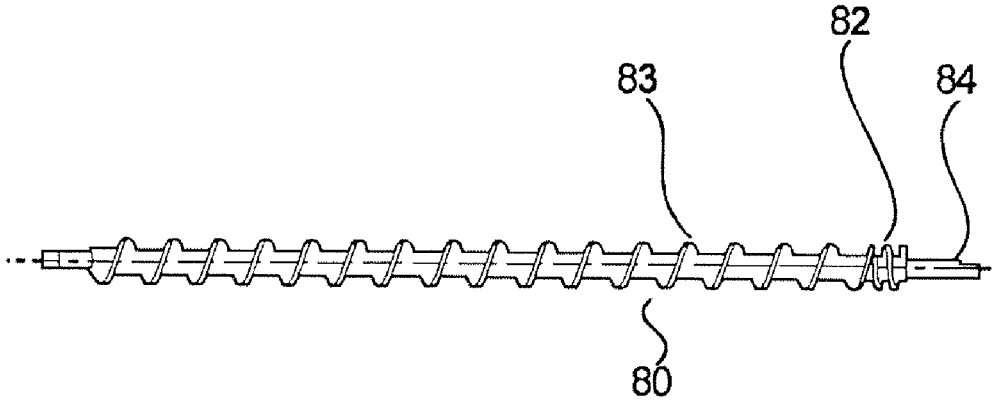
FIG. 4 is an external view of the developer conveyance screw in accordance with the present invention.

The developer conveyance screw 80 will be described with reference to FIG. 4.

The screw 80 is made up of a shaft 84 formed of stainless steel, and thread portions 82 and 83 formed of ABS resin, around the shaft 84. The screw 80 is integrally formed by insert molding.

The shaft 84 is rotatably supported with a pair of bearings located in the developing apparatus 4, by its lengthwise ends, one for one, which are not covered with resin. To the shaft 84, driving force is transmitted from a driving mechanism (unshown) from the right-hand side of FIG. 4.

As the screw 80 is rotated in the developer, the thread portion 83, which is spiral, is pressed (thrust) by the developer in the direction parallel with shaft 84. However, the screw 80 is prevented from moving relative to the developing apparatus 4 in the shaft direction. Therefore, the developer is moved in the direction opposite to the direction in which the screw 80 is pressed by the developer.

In this embodiment, the direction in which the thread portion 83 is twisted is the left-hand direction, for example, and the direction in which the shaft 84 is rotated is the counterclockwise direction, as seen from the direction from which the screw 80 is driven (from left-hand side of drawing). Thus, the thrust is generated in the rightward direction of the drawing. Therefore, the developer moves leftward.

After being moved leftward, the developer is transferred into the chamber, which has the screw 80, through the aforementioned left hand gap in FIG. 3, for circulation. However, if the developer is compressed between the lengthwise left end of the screw 80 and the wall of the developer storage portion 4*h*, the amount of the torque necessary to drive the screw 80 increases. In order to prevent this problem, therefore, a reversal thread portion 82 of the screw 80, which is opposite in twist direction to the main thread portion 83 is provided, in addition to the main thread portion 83.

(Thread Shape of Screw)

Next, referring to FIGS. 5 and 6, the shape of the thread of the screw will be described.

Figure 5:
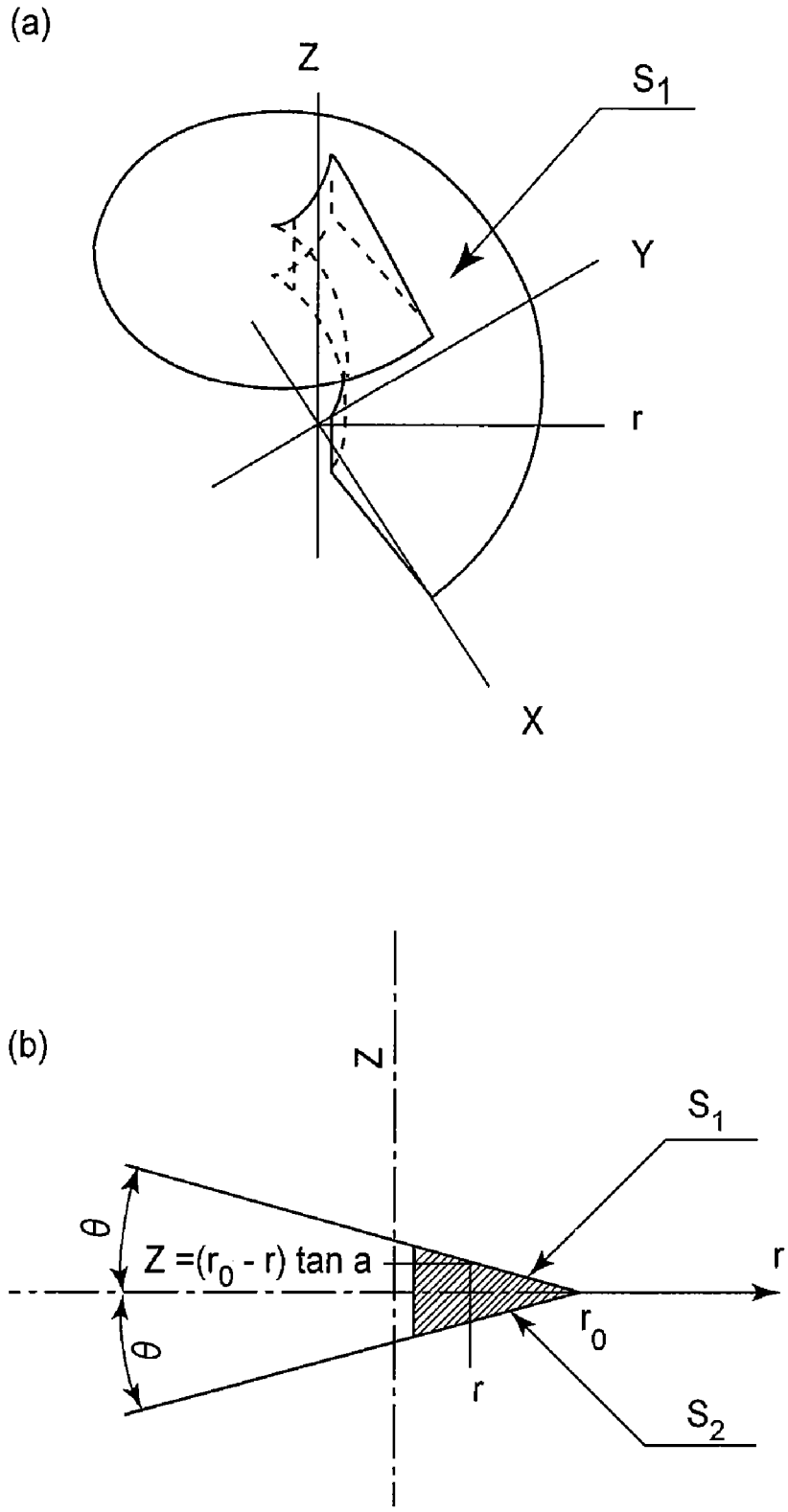
FIGS. 5(*a*) and 5 (*b*) are drawings showing the shape of the flank of the thread portion of the developer conveyance screw in accordance with the present invention.

Referring to FIG. 5(*a*), the thread shape of the screw will be described using the XYZ coordinate system and the cylindrical coordinate system (r, θ, z). The rotational axis of the shaft coincides with the axis Z.

Referring to FIG. 5(*b*), which shows a screw, the flanks of the thread portion of which are straight in cross section, the x component of the outward normal line of the surface S1 of this screw and the x component of the outward normal line of the surface S2 are obtained, using the following procedure.

A point on plane S1:

$$r = r,\ \theta = \theta,\ z = p\frac{\theta}{2\pi} + (r_o - r)\tan\alpha$$

An equation defining the plane S1:

$$F_1(r, \theta, z) = z - z(r, \theta) = 0 \qquad (1-1)$$

$$F_1(r, \theta, z) = z - p\frac{\theta}{2\pi} - (r_o - r)\tan\alpha$$

An outward normal line vector of the surface S1:

$$n_1 = grad\ F_1 = \left(\frac{\partial F}{\partial r}, \frac{1}{r}\frac{\partial F}{\partial \theta}, \frac{\partial F}{\partial z},\right) = \left(\tan\alpha, -\frac{p}{2\pi}, 1\right) \qquad (1-2)$$

n1 is converted into a o-xyz coordinate system, then the components are:

$$n_x = \cos\theta\ \tan\alpha + \frac{p}{2\pi r}\sin\theta \qquad (1-3)$$

$$n_y = \sin\theta\ \tan\alpha - \frac{p}{2\pi r}\cos\theta \qquad (1-4)$$

$$n_E = 1 \qquad (1-5)$$

From (1-3), x-component of the outward normal line vector of plane S1 is:

$$n_x = A\cos(\theta - \xi) \tag{1-6}$$

$$\text{where } A = \sqrt{\tan^2\alpha + \left(\frac{p}{2\pi r}\right)^2}$$

$$\tan\xi = \frac{p}{2\pi r} \Big/ \tan\alpha$$

A point on plane S2:

$$r = r,\ \theta = \theta,\ z = p\frac{\theta}{2\pi} - (r_o - r)\tan\alpha$$

An equation defining plane S2:

$$F_2(r, \theta, z) = z - p\frac{\theta}{2\pi} + (r_o - r)\tan\alpha$$

An outward normal line vector of the plane S2:

$$n_2 = -grad\ F_2 = \left(\tan\alpha,\ \frac{p}{2\pi r},\ -1\right) \tag{2-2}$$

Similarly to S1:

$$n_x = \cos\theta\ \tan\alpha - \frac{p}{2\pi r}\sin\theta = A\cos(\theta + \xi) \tag{2-6}$$

$$\text{where } A\sqrt{\tan^2\alpha + \left(\frac{p}{2\pi r}\right)^2}$$

$$\tan\xi = \frac{p}{2\pi r} \Big/ \tan\alpha$$

From (1-6), the x component of the surface S1 is positive within the range of ±π/2 from ξ(θ=ξ). Therefore, the undercut does not occur in this range. From (2-6), the x component of the surface S2 is positive within the range of ±π/2 from -ξ(θ=−ξ). Therefore, the undercut does not occur in this range. Thus, it is theoretically possible that as long as the mold for forming the screw 80 (81) is made so that it is separated into two pieces at the plane at which the x component of the outward normal line is zero, the mold does not create the undercut in terms of the two directions (± direction of X axis). However, as will be evident from Equations (1-6) and (2-6), ξ which determines the position of the borderline (mold separation line) is a function of the radius r. Therefore, the mold separation plane has to be curved. In reality, it is very difficult to make a two-piece mold for the screw 80 (81), which has a curved separation surfaces.

In this embodiment, therefore, in order to render straight the plane along which the mold for the screw 80 (81) is separated into two pieces for mold removal, the screw was given such a shape that the cross-sectional shape of the thread of the screw satisfies the following equations. Thread configuration of the thread:

EXAMPLE

Linear Configuration is $$Z(r) = (r_0 - r)\tan\alpha$$

When $$\text{よって } \tan\xi = \frac{-\frac{1}{r}\frac{\partial F}{\partial\theta}}{\frac{\partial F}{\partial r}} = \frac{\frac{p}{2\pi r}}{\frac{\partial F}{\partial r}} = \frac{\frac{p}{2\pi r}}{\frac{\partial Z(r)}{\partial r}} = -C:\ const \tag{1-6}$$

$$\frac{\partial Z(r)}{\partial r} = -\frac{1}{C}\frac{p}{2\pi r} \tag{3-1}$$

$$\therefore Z(r) = -\frac{1}{C}\frac{p}{2\pi}\ln|r| + C_1$$

At r=ro (outer diameter), Z(r)=0, then $$C_1 = \frac{1}{C}\frac{p}{2\pi}\ln|r_0|$$

From (3-1), $$Z(r) = -\frac{1}{C}\frac{p}{2\pi}\ln\frac{r_0}{r}$$

where

C=tan ξ:const

Figure 8:
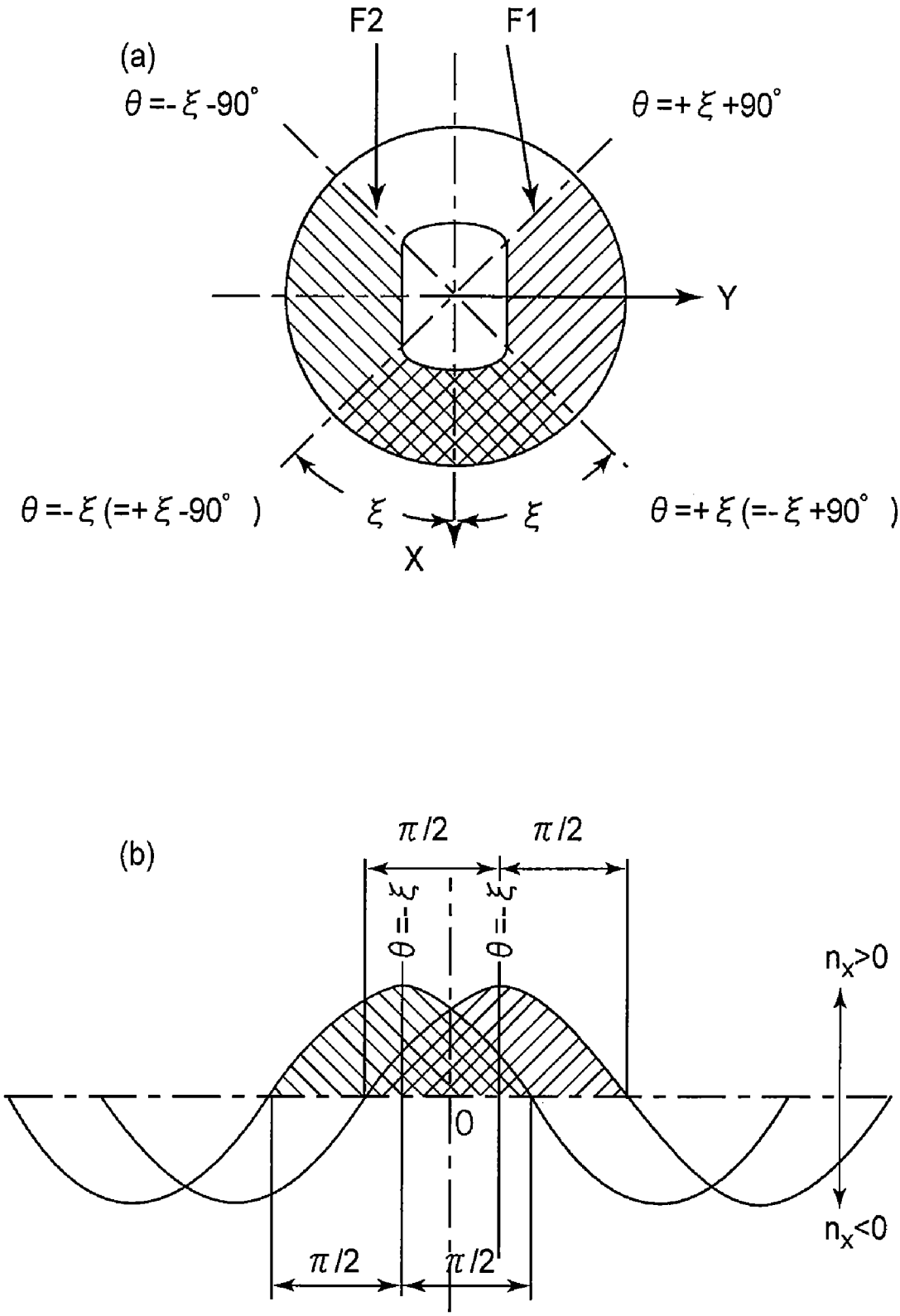
FIGS. 8(*a*) and 8(*b*) are drawings showing the separation plane at which the two piece mold for the developer conveyance screw in accordance with the present invention is to be separated.

In this embodiment, the screw 80 (81) was given an external diameter of 14 mm (shaft diameter of 6 mm), a pitch of 20, and ξ of 45° (θ=45°). Incidentally, S1 stands for one of the two surfaces (flanks) of the thread of the screw, and S2 stands for the other. Referring to FIGS. 8(*a*) and 8(*b*), the range of the surface S1 of one half of the mold which is removed in the +X direction (namely, the range of ≦$n_x$, in FIG. 8(*b*)) is: +ξ(=+45°)−90°≦θ≦+ξ(=+45°)+90°. Therefore, the separation surface F1 for separating the mold across the surface S1 is on θ=+ξ−90°=+ξ+90°. Further, in terms of the +X direction (namely, the range of ≦$n_x$, in FIG. 8(*b*)) in which the mold is removed, the range of the surface S2 of the mold is: −ξ(=−45°)−90°≦θ≦−ξ(=−45°)+90°. Therefore, the separation surface F2 for separating the mold across the surface S2 is on θ=−ξ−90°=−ξ+90°. ξcan take any value within 0≦ξ≦π/2. However, when ξ is no greater than 30°, the base of the thread becomes extremely thick compared to the ridge of the thread, reducing the screw in developer conveyance efficiency. Further, referring to FIG. 8(*a*), if ξ is excessively large, the shaft has to be reduced in diameter to prevent the creation of the undercut, reducing thereby the shaft in strength.

Figure 7:
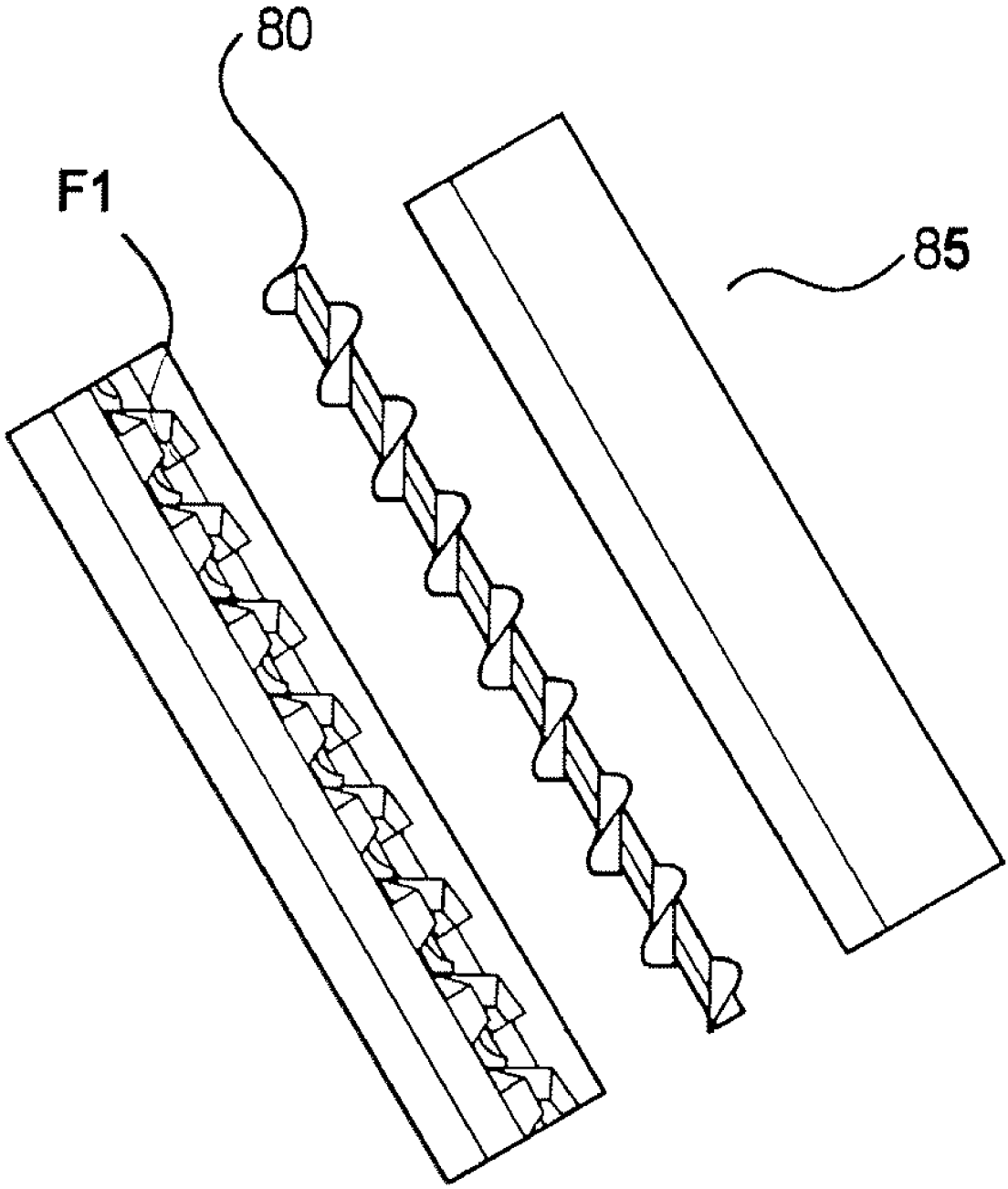
FIG. 7 is a schematic drawing of the two-piece mold for the developer conveyance screw in accordance with the present invention.

FIG. 7 shows the screw 80 in this embodiment, and the mold 85 for forming the screw 80. As will be evident from the drawing, the surfaces (F1 (F2 (unshown)) which result as the mold 85 is split into two pieces are completely flat, being therefore easier to form by machining. Therefore, it became possible for the first time to produce a practical two-piece mold for the screw 80.

This embodiment makes it possible to reduce the cycle time for forming the mold for the screw 80, making it therefore possible to achieve cost reduction.

This embodiment makes it possible to prevent the mold for the developer conveyance screw from becoming complicated in design.

Further, this embodiment affords more latitude in the design of the developer conveyance screw.

Further, this embodiment makes it possible to simplify the process for producing the mold for the developer conveyance screw, reducing thereby the cost for producing the mold for the developer conveyance screw.

Further, this embodiment makes it possible to produce a developer screw mold which yields multiple developer screws, improving thereby productivity.

Further, this embodiment makes it possible to improve in accuracy the developer conveyance screw manufactured by molding.

(Functional Advantages)

Next, the functional advantages of the screw 80 in this embodiment will be described.

Figure 6:
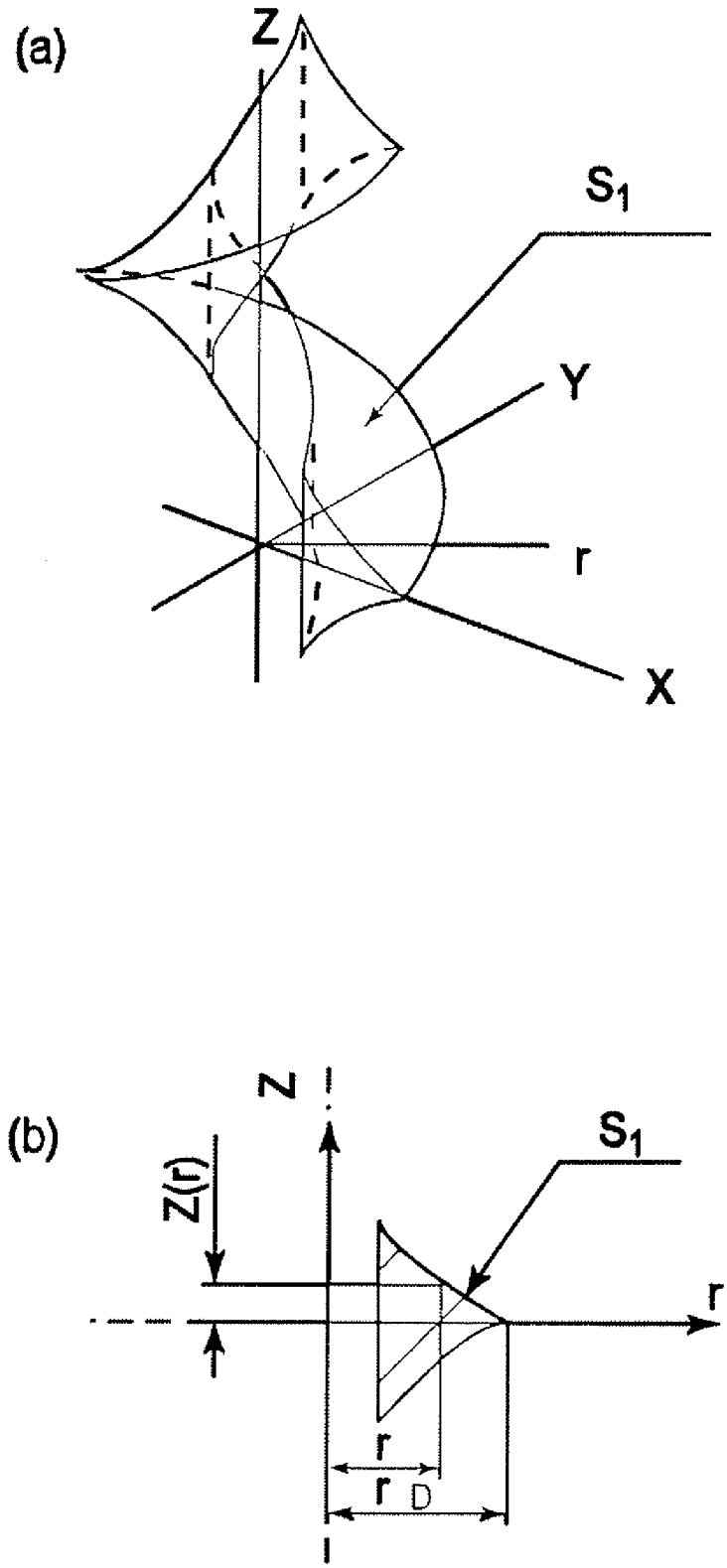
FIGS. 6(*a*) and 6(*b*) are drawings showing the cross sectional shape of the screw.

A developer conveyance screw, which is identical in cross section (shown in FIG. 6(*b*), the plane of which coincides with axial line of screw), is greater in stirring performance than a developer conveyance screw in accordance with the prior art, the flanks of which are straight as seen in cross section (shown in FIG. 6(*a*), the plane of which coincides with axial line of screw).

While the developer in the developing apparatus 4 is conveyed, while being stirred, by the developer conveyance screw, the developer is thrust by the flank of the screw in the circumferential direction of the screw (θ direction in cylindrical coordinate system), and also, in the direction parallel with the normal line of the flank (R Z plane).

With reference to the cross section, inclusive of axial line, of the developer conveyance screw in this embodiment, the flank has such a curvature that recesses inward of the thread. With the presence of this curvature, as the developer conveyance screw is rotated, the thrust which the developer receives from the flank of the screw continuously changes in the component, which coincides in direction with the normal line of the flank. Therefore, the direction in which the developer is made to flow continuously changes. The observation of the stirring of the developer by the developer conveyance screw in this embodiment revealed that the developer flowed from the base of the thread (shaft side) toward the ridge of the thread. However, the spill break occurred in the adjacencies of the ridge, reversing the direction in which the developer flowed.

As a result, the developer was sufficiently stirred and mixed at the interface between the body of the developer which was flowing in the normal direction, and the body of the developer which was flowing in the reverse direction. This is why the developer conveyance screw 80 in this embodiment is superior to a developer conveyance screw in accordance with the prior art, in terms of the level of uniformity at which developer is mixed (stirring performance) and the function of charging the toner. In other words, this embodiment improves a developer conveyance screw in the developer stirring performance, the level of uniformity at which developer is mixed, and the toner charging performance.

As for the index for the validity of the above described advantages of the developer conveyance screw in accordance with the present invention, when the developer conveyance screw in this embodiment was used, the length of the startup time of toner (length of time it takes for amount of toner charge to climb from 0 to 60% of saturation amount), in terms of the amount of specific charge, was roughly 80% of when a developer conveyance screw in accordance with the prior art, was used.

Incidentally, the preceding embodiment of the present invention was described with reference to the developing method which uses two-component developer. However, the above described screw 80 (81) can also be used with a developing method which uses single-component developer.

The present invention makes it possible to mold a developer conveyance screw, which is smooth in shape (uniform in cross section, at plane inclusive of axial line, of thread portion (spiral portion)), with the use of a two-piece mold.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 010361/2005 and 004719/2006 filed Jan. 18, 2005 and Jan. 12, 2006, respectively which are hereby incorporated by reference.

What is claimed is:

1. A developer feeding screw, which includes a shaft and a helical shape portion around said shaft, for feeding a developer in a direction of an axis of said shaft by rotation about the axis, said feeding screw, the improvement residing in that:

a sectional configuration of said helical shape portion in a plane including the axis satisfies:

$$Z(r)=kln(ro/r),$$

where z(r) is a height of said sectional configuration at radius r with z(ro)=0, (ro is an outer radius of the helical configuration):

r is a radius ($0<r\leqq ro$), and k is a constant.

2. A mold for manufacturing a developer feeding screw, which includes a shaft and a helical shape portion around said shaft, for feeding a developer in a direction of an axis of said shaft by rotation about the axis, said feeding screw, the improvement residing in that:

a sectional configuration of a part of said mold for forming said helical shape portion in a plane including a center of a part of said mold for forming said shaft satisfies:

$$Z(r)=kln(ro/r),$$

where z(r) is a height of said sectional configuration at radius r with z(ro)=0, (ro is an outer radius of the helical configuration):

r is a radius ($0<r\leqq ro$), and k is a constant.

* * * * *

UNITED STATES PATENT AND TRADEMARK OFFICE

CERTIFICATE OF CORRECTION

PATENT NO. : 7,366,451 B2
APPLICATION NO. : 11/275602
DATED : April 29, 2008
INVENTOR(S) : Katsunori Yokoyama It is certified that error appears in the above-identified patent and that said Letters Patent is hereby corrected as shown below:

COLUMN 2:

Line 57, "two piece" should read --two-piece--.
Line 60, "two piece" should read --two-piece--.
Line 61, "given" should read --be given--.
Line 67, "direction" should read --directions--.

COLUMN 4:

Line 13, "cross" should read --cross- --.
Line 19, "two piece" should read --two-piece--.
Line 65, "above described" should read --above-described--.

COLUMN 5:

Line 4, "medium 53," should read --medium 52,--.

COLUMN 10:

Line 21, "axis Z." should read --axis Z. ¶ Here, *p* stands for the pitch of the screw, and ro stands for the external diameter of the screw.--.
Line 55, "n1" should read --$n_1$--.
Line 64, "$n_E = 1$" should read --$n_z = 1$--.

COLUMN 11:

Line 24, " $F_2(r,\theta,z) = z - p\frac{\theta}{2\pi} + (r_o - r)\tan\alpha$ " should read -- $F_2(r,\theta,z) = z - p\frac{\theta}{2\pi} + (r_o - r)\tan\alpha$ ··· (2–1)--.

Line 40, " $A\sqrt{\tan^2\alpha + \left(\frac{p}{2\pi r}\right)^2}$ " should read -- $A = \sqrt{\tan^2\alpha + \left(\frac{p}{2\pi r}\right)^2}$ --.

Line 66, "equations. Thread" should read --equations. ¶ Thread--.

UNITED STATES PATENT AND TRADEMARK OFFICE

CERTIFICATE OF CORRECTION

PATENT NO. : 7,366,451 B2
APPLICATION NO. : 11/275602
DATED : April 29, 2008
INVENTOR(S) : Katsunori Yokoyama It is certified that error appears in the above-identified patent and that said Letters Patent is hereby corrected as shown below:

COLUMN 12:

Line 49, "ξcan" should read --ξ can--.

COLUMN 13:

Line 25, "screw)." should read --the screw).--.
Line 31, "(R Z plane)." should read --(R-Z plane).--.
Line 60, "above described" should read --above-described--.

COLUMN 14:

Line 11, "above described" should read --above-described--.

Signed and Sealed this

Twenty-third Day of September, 2008

JON W. DUDAS
*Director of the United States Patent and Trademark Office*